United States Patent [19]

Vilain

[11] 4,152,088

[45] May 1, 1979

[54] OFF-SHORE OIL FIELD PRODUCTION EQUIPMENT

[75] Inventor: Robert Vilain, Maisons-Alfort, France

[73] Assignee: Enterprise d'Equipments Mecaniques et Hydrauliques EMH, France

[21] Appl. No.: 866,392

[22] Filed: Dec. 30, 1977

Related U.S. Application Data

[63] Continuation-in-part of Ser. No. 810,189, Jun. 27, 1977.

[30] Foreign Application Priority Data

Jun. 30, 1976 [FR] France ..... 76 19961
Jun. 8, 1977 [FR] France ..... 77 17557

[51] Int. Cl.[2] ..... E02D 21/00; B63B 35/44

[52] U.S. Cl. ..... 405/195; 405/202; 405/203; 405/205; 114/254

[58] Field of Search ..... 61/95, 101, 87, 88, 61/48; 9/8 P; 166/0.5; 141/389, 381; 114/230, 254; 175/5, 7

[56] References Cited

U.S. PATENT DOCUMENTS

| | | | |
|---|---|---|---|
| 3,535,884 | 10/1970 | Chaney | 61/101 |
| 3,656,307 | 4/1972 | Mott | 166/0.5 |
| 3,712,068 | 1/1973 | Liautaud | 61/101 |
| 3,756,293 | 9/1973 | Adler et al. | 137/236 |
| 3,875,998 | 4/1975 | Charpentier | 166/0.5 |
| 3,881,549 | 5/1975 | Thomas | 166/0.5 |

*Primary Examiner*—Jacob Shapiro
*Attorney, Agent, or Firm*—Steinberg & Blake

[57] ABSTRACT

Off-shore oil field production equipment with a production platform anchored on the ground of the drilling site, comprising a column pivotally connected through a universal cardan joint coupling to a base anchored to the sea bed in connection with a remote-located floating gas flare for burning gas extracted from the oil, wherein said gas flare is carried by a floating structure coming up into the wind while being connected to a swivel head of the column by means of a pivoted holder.

11 Claims, 9 Drawing Figures

OFF-SHORE OIL FIELD PRODUCTION EQUIPMENT

The present invention is a continuation-in-part of U.S. Pat. application Ser. No. 810,189 filed on June 27, 1977.

The invention relates to off-shore oil field production equipment, outfit or like rigging comprising off-shore platforms or the like.

Its main object is the provision of a number of arrangements to be used together or separately with a view to substantially cutting down the investment costs and making fields payable or workable with small outputs or flow rate capacities.

It consists according to one of such arrangements to make use of a production of platform in particular of the kind anchored or fastened onto the ground of the sea bed or bottom of the drilling site and for instance pivotally connected to a base member, such platform comprising an oil and gas separator or like trap and being combined with a gas flare adapted to be located at a suitable distance from the center line of the platform, said gas being carried by a floating support coming up into the wind or orienting itself in the eye of the wind while being connected through at least one articulated arm to a rotary element in particular a swivel or revolving head of the platform.

Another arrangement consists in connecting by means of an oil pipe-line to a production platform in particular of the kind just referred to herein above, a combined storage and lading platform assembly having in particular a base member anchored to the ground or the sea bed and forming a storage tank and at least one articulated column on this base member, which column is fitted with an equipment for loading oil tankers in particular of the type described, in U.S. Pat. No. 3,980,037 and patent application Ser. No. 736,365 in the name of the Applicant Company.

Said production column or tower may be associated with a number of wells distributed about its base member or also said wells may be drilled from said base member, in combination with valve and manifold systems enabling the crude oil to be carried along or conveyed towards the separator, thence the oil released toward the storage and lading column or tower.

Apart from said arrangements the invention comprises some other contrivances or appliances which are used preferably at the same time and which will be set forth the more explicitly hereinafter.

The invention is more particularly directed to some embodiments for applying as well as to some embodiments for carrying out said arrangements and it is more especially aiming in particular by way of new industrial products, at equipment of the kind referred to, adapted to apply said arrangements as well as at the special elements required for devising or making same and installations or plants comprising such an equipment.

The invention will be better understood and further objects, details, characterizing features and advantages thereof will appear more clearly as the following description proceeds with reference to the accompanying diagrammatic drawings given by way of non-limiting examples only illustrating several specific presently preferred embodiments of the invention and wherein;

FIG. 1 is a perspective diagrammatic view showing an oil production plant or system designed according to the invention;

FIGS. 2 and 3 separately show on a larger scale, the structure supporting the gas flare and forming part of said system in accordance with the invention;

According to the invention and more especially to that one of its applying embodiments as well as to those of the embodiments of its various parts which seem to be referred construction at present, it is intended for instance to design or establish a plant or a system for the production, storage and lading of oil products from the wells of an off-shore or submarine oil field and such a design should be carried out as follows or in a similar manner.

Figure 1:
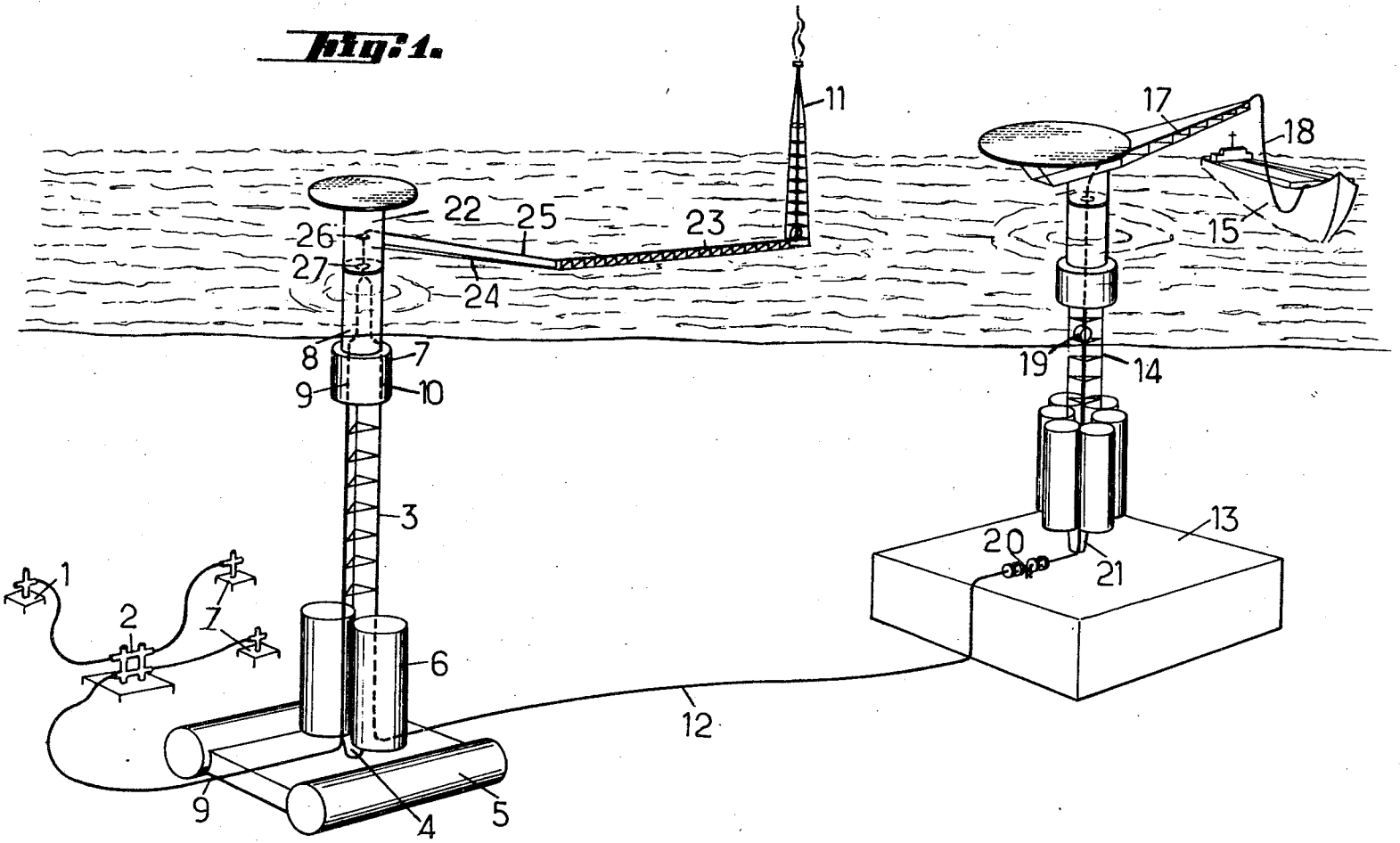

Such a system should comprise:

a number of wells which are to be drilled from a movable derrick platform or from a drilling ship or in any other fashion whatsoever such wells being provided with their usual accessories and fittings such as protection casings, safety or relief valves, storm chokes etc., their upper portion forming the well-head seen at 1 in FIG. 1;

a manifold device such as shown at 2 in combination with sets of valves and pipings enabling productions of the wells to be collected or gathered, whereas these valves may be accomodated or housed on the sea bed or on the production column or tower to be described hereinafter;

the production tower proper which according to the most advantageous embodiment consists of an articulated column 3, mounted through a universal cardan coupling 4 onto a base member 5 with ballast tanks 6 and at least one float means 7 providing through the hydrostatic thrust for keeping a substantially vertical position, such a column being moreover provided with an oil and gas separator arrangement or trap 8 fed with crude oil through a duct 9 and from which the crude oil is flowing out in purified or scrubbed condition through a duct 10 extending down the column for conveying the scrubbed or purified crude oil or oil towards the storage and lading equipment;

a gas flare 11 adapted to burn the gas flowing from the separator and which preferably has the construction described hereinafter;

and the storage and lading equipment supplied by an oil pipeline 12 following or continuing the duct 10, which equipment consists advantageously, on one hand, of a base 13 anchored to the ground or sea bottom and forming a storage tank of any size and, on the other hand, of a lading platform carried advantageously out as an articulated column or tower 14 pivotally connected through a universal cardan coupling at 21 to the base and provided with means for mooring ships 15, said column including in particular a swivel or revolving head 16 and a boom 17 adapted to carry the lading line 18 according to the arrangements of U.S. Pat. No.

3,980,037 in the name of the applicant Company, the whole assembly being of course combined with pumps 19 and valves 20 for drawing at will oil from the base-tank 13 or for storing it thereinto.

Referring more particularly to the gas flare 11 it is carried out in such a manner according to one of the arrangements of the invention, that it is located at sea at a substantial distance from the production column (for instance at 100 m to 200 m) while being carried by a floating structure adapted to come up into the wind or to orient itself in the eye of the wind, said structure being connected to a platform so as to be able to turn around the latter, and for this purpose the platform comprises a swivel or revolving head 22 to which is pivotally connected an arm connecting that head to said structure.

The floating structure 23 carrying the gas flare 11 at one end thereof consists advantageously of an assembly of generally square, triangular or other cross sectional contour, consisting of suitably trussed or braced tubes, such a structure being little sensitive to the effects of the swell. The structure is connected to the swivel head 22 by at least one arm 24 itself built up from tubes and pivotally bearing with its ends, respectively, on the one hand on the head 22 about a horizontal axis A—A and, on the other hand, on the structure 23 about another horizontal axis B—B (FIG. 2).

The sizes of the tubes of the structure 23 are designed so that the water line is located nearly half-way of the height of the vertical cross-section as shown in FIG. 3.

Said tubes may possibly be used for conveying gas but it seems preferable on account of safeness grounds to use independent pipings such as 25 the end of which towards the column is connected to the outlet pipe from the separator by means of swivel or rotary joints diagrammatically shown at 26,27.

Such a structure undergoes from the sea, even in case of storm substantially lower stresses than a normal ship. It should be pointed out indeed that the oscillating motion of the articulated column would be braked by the movements of this structure in the water and that it will result therefrom within the connecting arm 24 and its pivotal connections, efforts or strains which will remain small whereas they could become very large if the gas flare 11 had the shape and weight of a ship of the same length (the expedient of using a support forming the hull of a ship being however not discarded).

Figure 4:
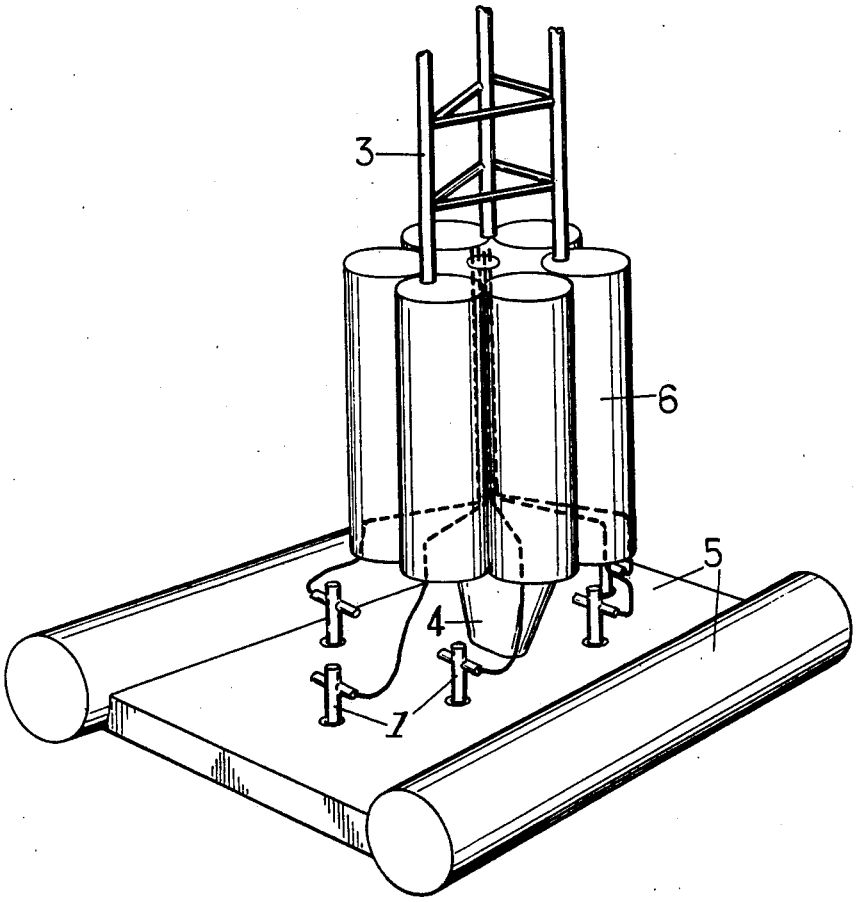
FIG. 4 is a perspective view illustrating the base or bottom portion of a production column or tower of the type shown in FIG. 1 according to an alternative embodiment of the invention.

In FIG. 4 has been shown an alternative embodiment of the system wherein the well heads extend through the base 5 of the production column and are secured thereto in the case where that base is of a large size (with for instance each side thereof measuring 50 m to 100 m).

In such a case, the base alone is installed first and the wells are drilled at the sites or locations provided for that purpose by means of a movable platform of known kind carrying a drilling equipment or derrick and using the engineering process of making directional wells in order to reach the full extent or bulk of the oil pool.

Once the wells have been completed and provided with their control members the articulated production column or tower is installed and the oil collecting pipelines are connected between the base and the column.

The advantage of such an alternative embodiment is that it becomes possible by means of a simple and economical equipment carried by the column to accomplish on the well heads and inside thereof any maintenance works or operations that could prove necessary.

In this connection the column may comprise all servicing means for controlling and possibly loading the well heads and/or their accessories (valves etc.) according to the features disclosed in the co-pending patent application in U.S.A. Ser. No. 802,051 filed on May 31, 1977 in the name of the Applicant Company.

Irrespective of the form of embodiment chosen, it is possible, owing to the invention to carry out oil field production equipment the operation of which is enough understandable from the previous considerations so that any further description thereof may be dispensed with, said equipment exhibiting with respect to those of the type referred to already known or existing many advantages among which:

the advantage of concentrating to the greatest possible extent the various essential parts on the platforms involved;

the subsequent advantage of a cutting down the design or installation costs even for deep water platforms (installed at depths of 100 m to 200 m for instance);

the advantage of allowing to easily store the production of several days when bad wheather would prevent an oil tanker from carrying it away; the base member 13 of the production column or tower may exhibit a large storage capacity;

and the advantage of providing for a better supervision or monitoring of the various parts of the whole system.

FIGS. 5 to 9 in particular illustrate improvements made to the gas flare system.

According to the alternative embodiments shown, an oil field production equipment with a gas flare associated with a sea-bed development or working structure and carried by a floating or buoyant support is characterized in that said floating or buoyant support consists of at least one submerged float topped by an emerging holding mast bearing said gas flare. Moreover, the flare feeding supply pipe-line which is relatively long since said gas flare should be located rather far away from said sea-bed development structure is stiffened or strengthened by a lattice beam or like trussed girder or framework alongside of which it is secured in order to provide a substantially horizontal emerging arm pivotally connected to said working structure and held above water level by said holding mast.

More specifically, FIGS. 5 to 9 show one part of an oil field production equipment comprising in particular a sea-bed development or working structure 111 and a gas flare 112 coupled to the working structure 111 and kept above water level by a floating or buoyant support 113 consisting essentially according to the invention of a submerged float member 114 topped by an emerging holding mast 115 bearing the gas flare 112. The gas flare 112 is separated from the remainder of a system by a heat shield 116. Furthermore the holding mast 115 is connected to the supply pipe-line 117 for the gas flare 112 and the major portion of this pipe-line extends substantially horizontally and is pivotally connected (pivotal connection 118) to the working structure 111. More specifically the pipe-line 117 is secured alongside of a lattice beam or like trussed girder or framework 119 which stiffens or strengthens same; the combination of said beam with said pipe-line forms an approximately horizontal emerging arm 120 kept above water level by means of the buoyant support 113 and determining the spacing between the gas flare 112 and the working structure 111.

With the expression "working structure" is meant any production equipment unit, outfit or like rigging to which the gas flare may be connected. Thus according to FIGS. 5 and 9 the structure 111 appears as beeing a platform such as a production platform whereas from FIGS. 6 to 8 it appears that the working structure 111 may consist of a production and/or separator column or tower, whereas the structure may be connected to the sea bed or bottom in stationary or pivoting relationship. In the case of a production and/or separation column the emerging arm 120 is pivotally connected to a revolving head 122 mounted in coaxial relation to the emerging top portion of the column. Said working structure could also consist of a ship such as for instance a tanker. The pipe-line 117 may comprise several gas carrying duct sections $117_a$, $117_b$ (FIG. 7) secured alongside the lattice beam 119 or being integral therewith. Moreover, said lattice beam 119 could be arranged (in a manner the showing of which is believed unnecessary) suitable for serving as a service footbridge or like gang-way between the working unit 111 and the gas flare 112. Now the various embodiments according to the invention, for providing connection between the gas flare 112 and the emerging arm 120 on the one hand and the buoyant support 113 on the other hand will be described.

Figure 8:
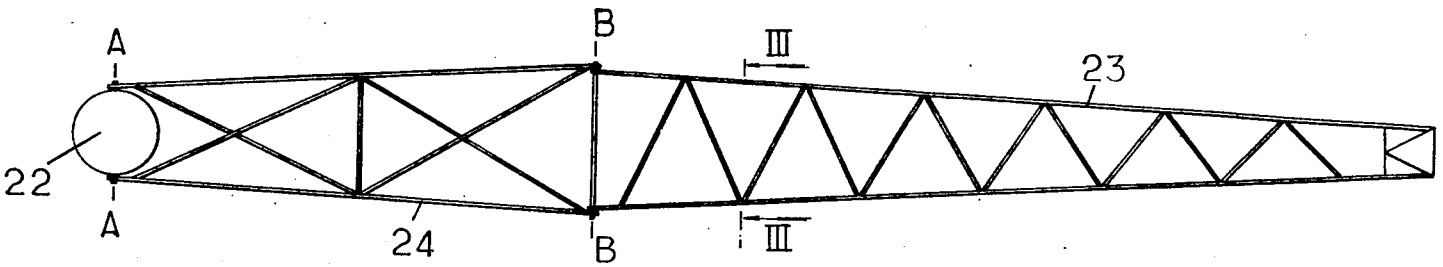
FIG. 8 is a view similar to FIG. 6 but illustrating the behaviour of the system in the swell.
Figure 5:
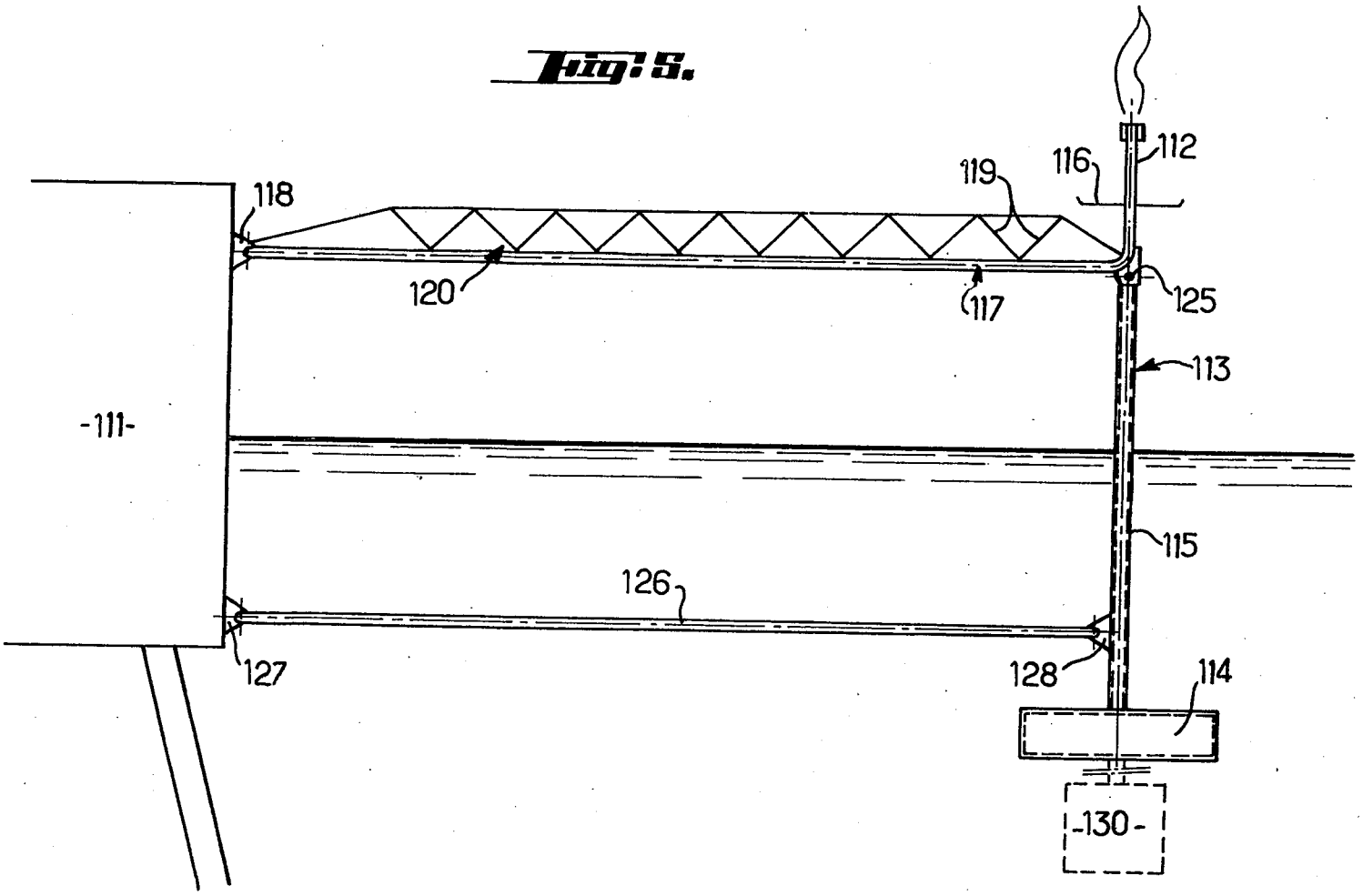
FIG. 5 is a diagrammatic elevational view of a possible improved embodiment of the invention.
Figure 6:
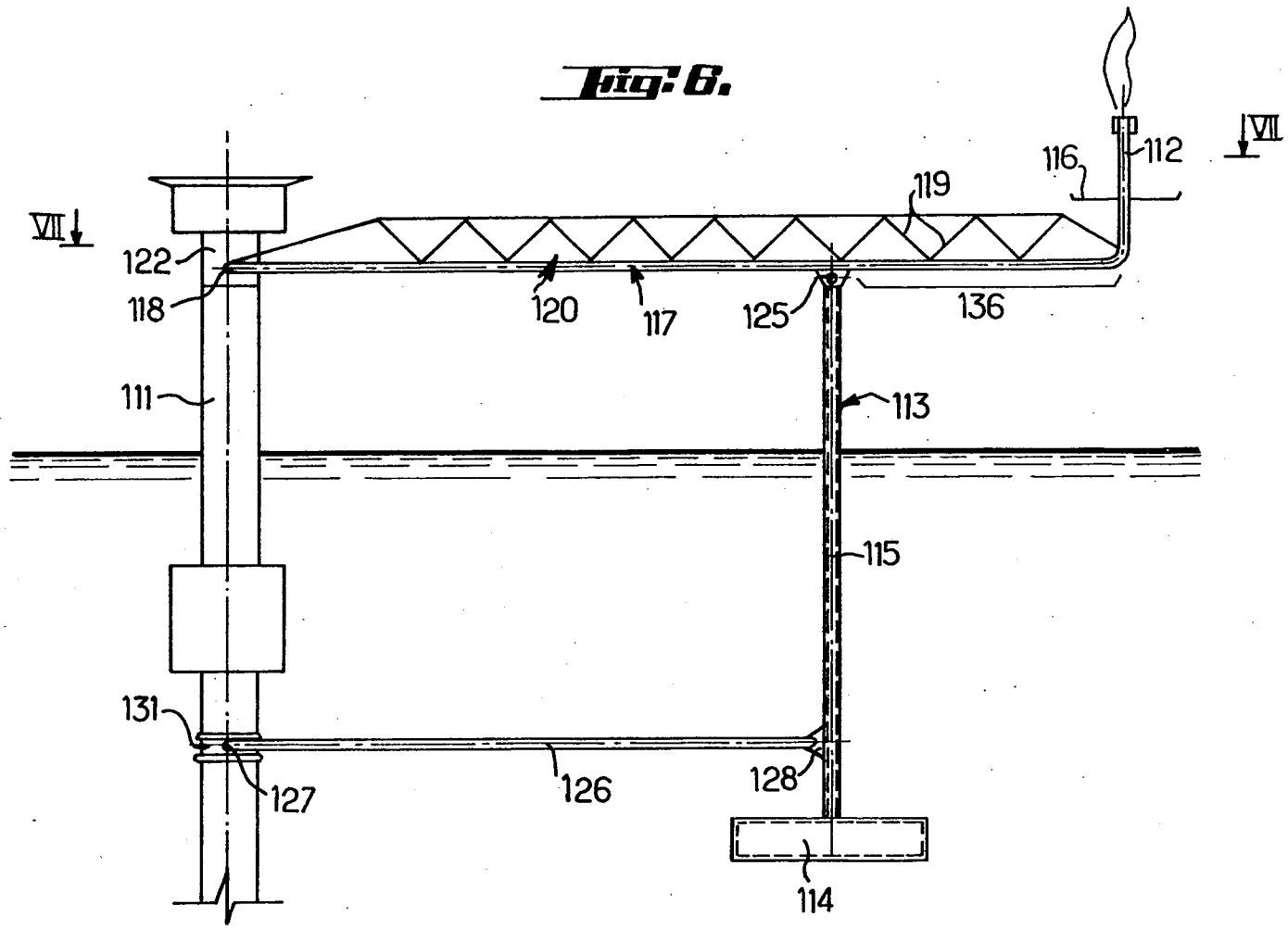
FIG. 6 is a similar view of another alternative embodiment according to the principle of the invention.
Figure 7:
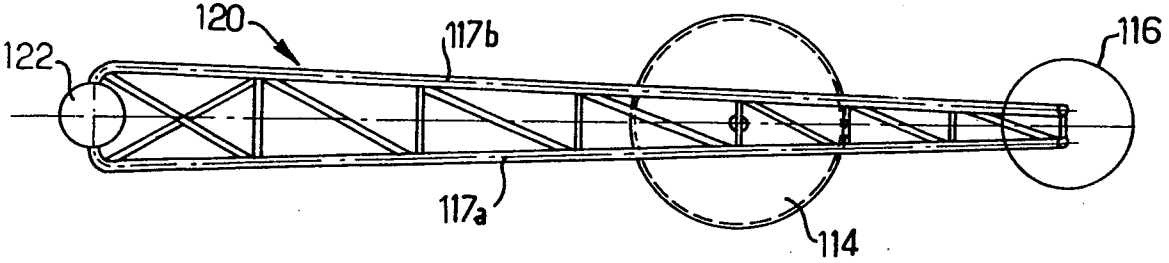
FIG. 7 is a view in cross-section taken upon the line VII—VII of FIG. 6.
Figure 8:
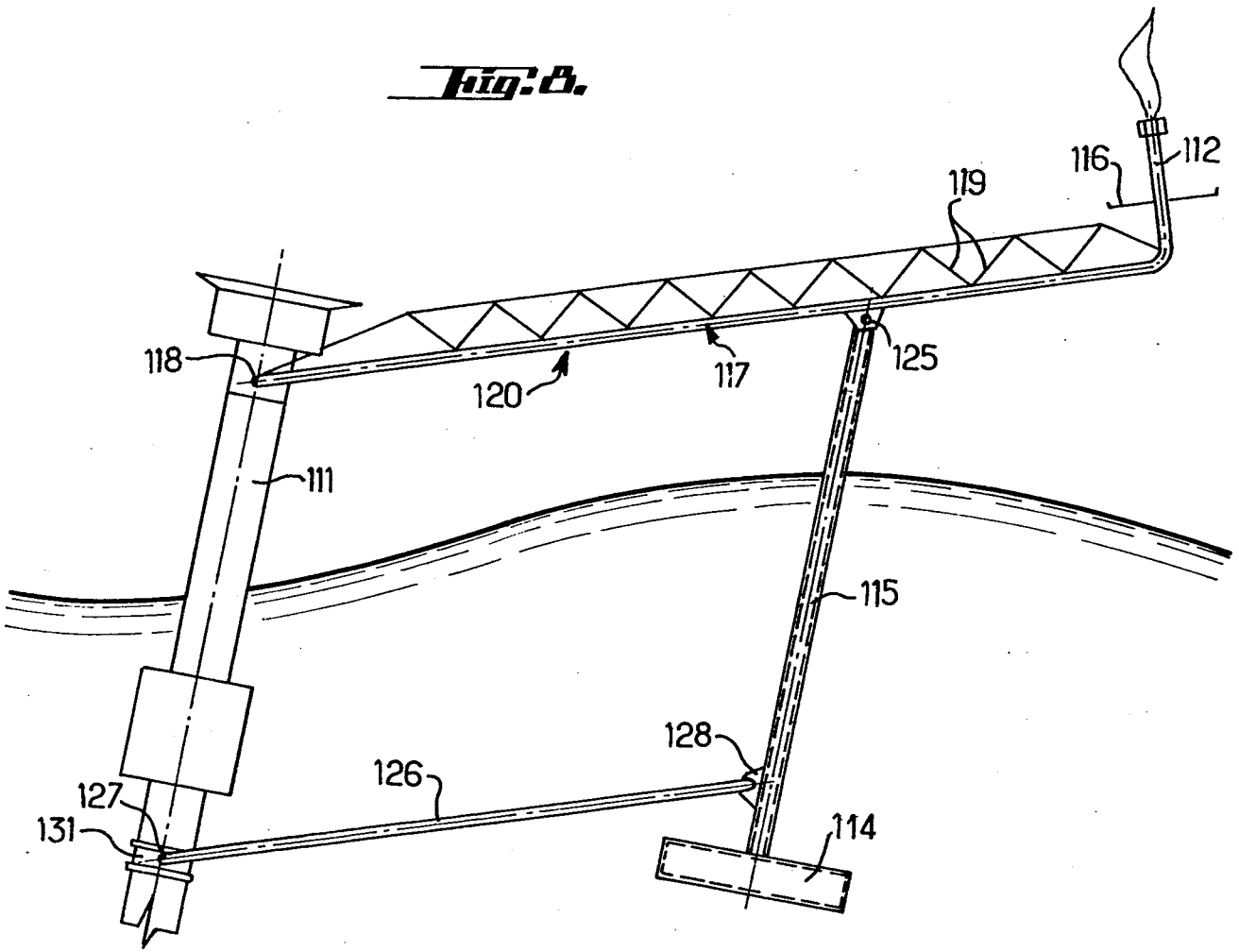
Figure 9:
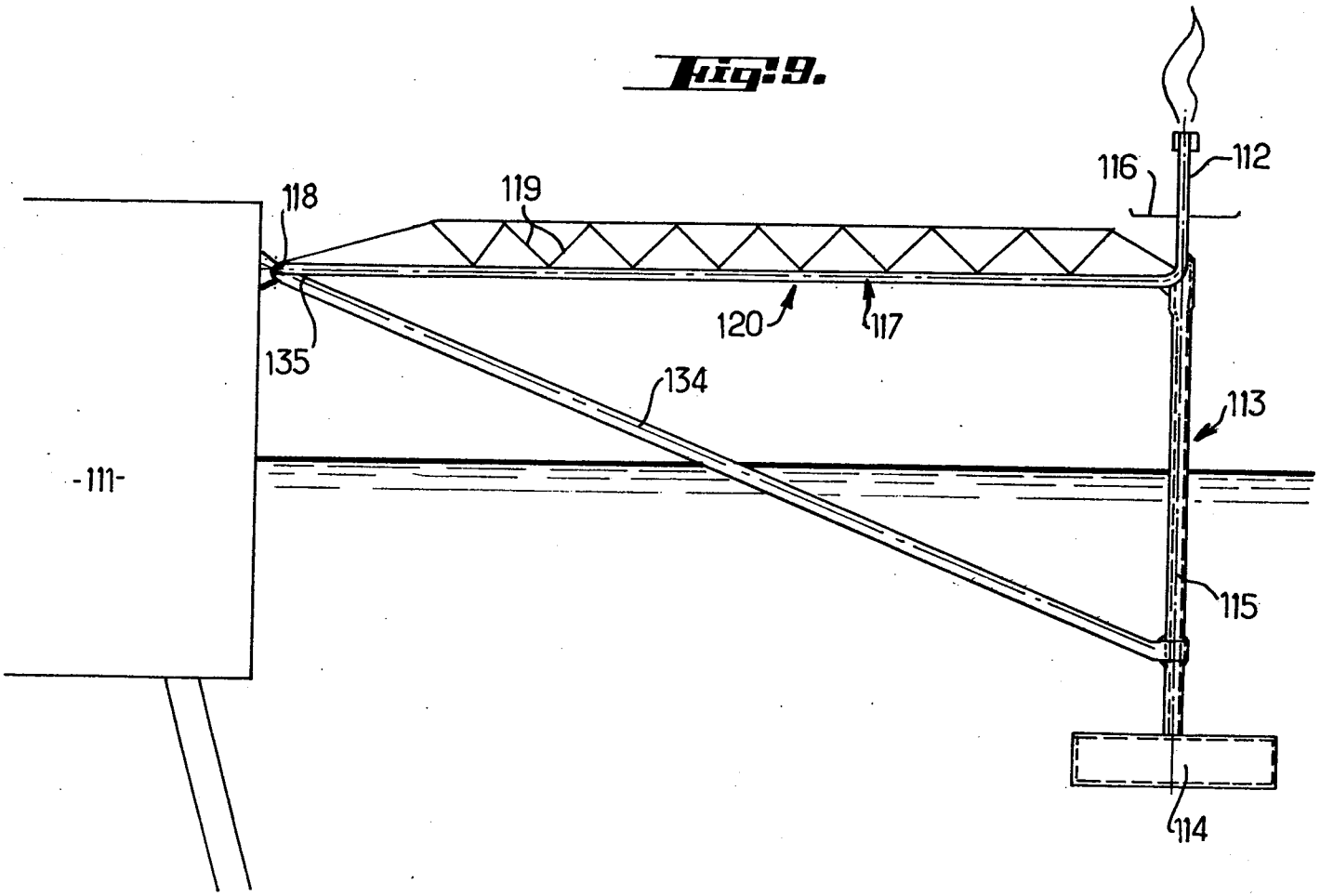

As shown in particular in FIGS. 5, 6 and 8 the holding mast 115 may be pivotally connected (pivotal connection 125) to the emerging arm 120. In such a case, it is necessary to provide a submerged arm 126 extending in substantially parallel relation to the arm 120 and pivotally connected with both of its ends, respectively, to the working structure 111 (through pivotal connection 127) and to said holding mast 115 (pivotal connection 128). Thus, the submerged arm 126 forms a kind of parallel-motion linkage or deformable parallelogram together with the emerging arm 120, the holding mast 115 and a portion of the working structure 111. The submerged arm 126 may however be omitted or dispensed with if the buoyant support 113 is provided with a ballasting mass 130 located below the float 114 (FIG. 5). It is of course also possible to combine together a ballasting mass such as 130 and a submerged arm 126. In the case of FIGS. 6 to 8 where the working structure consists of a column the submerged arm 126 would be pivotally connected to a rotating ring 131 or like collar rotatably mounted about the column forming the working structure 111 while being arranged in coaxial relation to the revolving head 122.

FIG. 8 shows the behaviour of such a system under the action of the swell in particular when the column forming the working structure 111 is connected to the sea bed through the agency of a pivotal connection forming a universal cardan joint coupling as is well known in the prior state of the art. When the working structure is tilting from the vertical direction under the influence of the swell the parallel-motion linkage or parallelogram defined hereinabove would deform itself thereby avoiding giving rise to excessive stresses or strains while retaining the emerging arm 120 and especially the gas flare 112 above water level.

Figure 9:
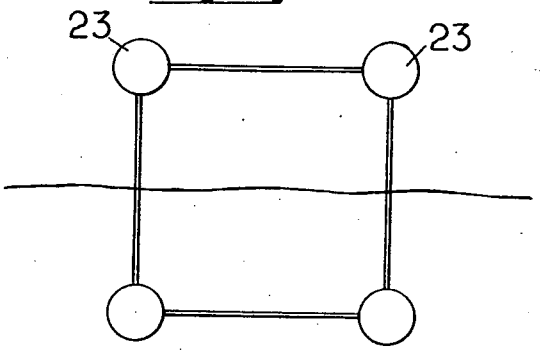
FIG. 9 is still another possible alternative embodiment of the system according to the invention.

FIG. 9 shows another alternative embodiment wherein the holding mast 115 may be rigidly connected to the emerging arm 120 and extends at right angles thereto (the pivotal connection 125 being omitted). Moreover, there should be provided at least one lacing bar or like triangulation element 134 forming a brace, strut or like stay member mounted in diagonally extending relationship between a point 135 of the emerging arm 120 preferably near the working structure 111 and the holding mast 115 in particular at a location adjacent to the float or buoyant member 114. The assembly between the emerging arm 120, the holding mast 115 and the triangulation element or lacing bar 134 may however also be effected by means of pivotal connections, the triangular configuration thus achieved being not deformable.

It should be pointed out that the holding mast 115 may be assembled to the emerging arm 120 in extension of or in aligned registering relationship with the gas flare 112 i.e. at one end of the emerging arm 120 as shown in FIGS. 5 and 9 but also and preferably at an intermediate point thereof as clearly seen in FIGS. 6 to 8. Thus the remaining portion 136 of the emerging arm 120 carrying the gas flare 112 is mounted as a cantilever framework in overhanging relationship with respect to the holding mast 115 thereby enabling the construction of the beam 119 to be of reduced weight. It should also be noted that the pivotal connections 118 and 127 in the case where the working structure is stationary and does not include any rotary or swivel head preferably are of the ball-and-socket joint type. Advantageously the pivotal connection 118 is hollow to form a passage- way for the flow paths of travel of fluids or ducts such as $117_a$, $117_b$.

The gas flare arrangement connected to a working structure such as just described according to the present invention is of a cost price substantially lower than any prior art system and in addition exhibits a very high operating reliability to the extent where the gas flare 112 may be located at a distance of more than hundred meters away from the working structure without the passage-way lines for the gases to be burnt contacting the sea.

It is to be understood that the invention should not be construed as limited to the embodiments of equipment just described since it comprises any technical equivalents of the means provided if the latter are used within the scope of the appended claims.

What is claimed is:

1. An off-shore oil field production equipment having a sea bed working structure including apparatus adapted to be anchored to the sea bed of a drilling site and operatively associated with a remote-located gas flare for burning gas extracted from crude oil, wherein the improvement comprises said gas flare is carried by a floating support comprising at least one submerged float topped by an emerging holding mast bearing said gas flare and wherein said holding mast is connected to a rigid or stiffened supply piping for feeding said gas flare, said piping comprising a substantially horizontal portion pivotally connected to said working structure.

2. An equipment according to claim 1, wherein said piping is secured alongside of a latter beam so as to form therewith an approximatively horizontal emerging arm.

3. An equipment according to claim 2 wherein said working structure comprises an oil field development column connected to the sea bed and provided at its emerging top portion with a substantially coaxial revolving head, wherein said emerging arm is pivotally connected to said revolving head.

4. An equipment according to claim 2, wherein said working structure is a platform.

5. An equipment according to claim 2, wherein said working structure is a ship such as a tanker.

6. An equipment according to claim 2, wherein at least one lacing bar forming a bracing element is mounted diagonally extending relationship between one point of said emerging arm near said working structure and a point of said holding mast adjacent to said float.

7. An equipment according to claim 2, wherein said holding mast is pivotally connected to said emerging arm.

8. An equipment according to claim 7, wherein said floating support is provided with a ballasting mass.

9. An equipment according to claim 7, comprising an approximatively horizontal submerged arm pivotally connected with both of its ends to said working structure and to said holding mast, respectively, thereby substantially defining a parallel-motion linkage forming a deformable parallelogram with said emerging arm, said holding mast and one portion of said working structure.

10. An equipment according to claim 9, wherein said submerged arm is pivotally connected to a rotary ring-like collar rotatably mounted about said column in substantially coaxial relationship with a revolving head.

11. An equipment according to claim 2, wherein said holding mast is assembled to said emerging arm at an intermediate point thereof, the remaining portion of said arm which carries said gas flare being thus mounted as a cantilever beam in overhanging relationship with respect to said holding mast.

* * * * *